US008732984B2

(12) United States Patent
Ha

(10) Patent No.: US 8,732,984 B2
(45) Date of Patent: May 27, 2014

(54) SHOCK ABSORBING SHOES WITH TRIANGLE SHOCK ABSORBING SPACE

(71) Applicant: Yong-ho Ha, Busan (KR)

(72) Inventor: Yong-ho Ha, Busan (KR)

( * ) Notice: Subject to any disclaimer, the term of this patent is extended or adjusted under 35 U.S.C. 154(b) by 0 days.

(21) Appl. No.: 13/869,127

(22) Filed: Apr. 24, 2013

(65) Prior Publication Data

US 2014/0101972 A1 Apr. 17, 2014

Related U.S. Application Data

(63) Continuation of application No. PCT/KR2012/010828, filed on Dec. 13, 2012.

(30) Foreign Application Priority Data

Oct. 16, 2012 (KR) ..... 10-2012-0114966

(51) Int. Cl.
*A43B 13/18* (2006.01)

(52) U.S. Cl.
CPC ..... *A43B 13/18* (2013.01); *A43B 13/181* (2013.01)
USPC ..... 36/28

(58) Field of Classification Search
CPC combination set(s) only.
See application file for complete search history.

(56) References Cited

U.S. PATENT DOCUMENTS

| | | | | |
|---|---|---|---|---|
| 5,337,492 | A * | 8/1994 | Anderie et al. | 36/28 |
| 7,159,339 | B2 * | 1/2007 | Mathieu et al. | 36/30 R |
| 8,151,485 | B2 * | 4/2012 | Hurd et al. | 36/27 |
| 8,365,440 | B2 * | 2/2013 | Rivas et al. | 36/30 R |
| 8,490,296 | B2 * | 7/2013 | Hurd et al. | 36/27 |
| 2007/0068046 | A1 * | 3/2007 | Mathieu et al. | 36/102 |
| 2009/0013556 | A1 * | 1/2009 | Nishiwaki et al. | 36/28 |
| 2010/0236096 | A1 * | 9/2010 | Pauk et al. | 36/28 |
| 2011/0185590 | A1 * | 8/2011 | Nishiwaki et al. | 36/28 |
| 2011/0214314 | A1 * | 9/2011 | Baker et al. | 36/134 |
| 2012/0042539 | A1 * | 2/2012 | Miner | 36/29 |
| 2012/0079747 | A1 * | 4/2012 | Seo | 36/25 R |

* cited by examiner

*Primary Examiner* — Marie Bays
(74) *Attorney, Agent, or Firm* — Park & Associates IP Law, P.C.

(57) ABSTRACT

A shock absorbing shoe with a triangle shock absorbing space, the shoe having an outsole and a midsole, wherein the midsole is divided into upper and lower midsoles, a plurality of upper seating holes provided on opposite sides of the upper midsole behind an area corresponding to an arch region of a foot sole, a plurality of lower seating holes provided on opposite sides of the lower midsole. The shoe includes a shock absorbing means having a body member formed longitudinally between the upper and lower midsoles, and wing members provided on opposite sides of the body member. Each wing member includes an upper inclined portion inclined upwards to be received in the associated upper seating hole, a lower inclined portion inclined downwards to be received in the associated lower seating hole, and a connecting portion connecting the upper and lower inclined portions.

5 Claims, 4 Drawing Sheets

SHOCK ABSORBING SHOES WITH TRIANGLE SHOCK ABSORBING SPACE

REFERENCE TO RELATED APPLICATIONS

This is a continuation of pending International Patent Application PCT/KR2012/010828 filed on Dec. 13, 2012, which designates the United States and claims priority of Korean Patent Application No. 10-2012-0114966 filed on Oct. 16, 2012, the entire contents of which are incorporated herein by reference.

FIELD OF THE INVENTION

The present invention relates, in general, to shock absorbing shoes with triangle shock absorbing spaces and, more particularly, to a shock absorbing shoe with a triangle shock absorbing space, which is configured such that triangle shock absorbing spaces are provided on opposite sides of the shoe, thus allowing shocks to be absorbed in a stable and balanced manner.

BACKGROUND OF THE INVENTION

Generally, shoes serve to protect a person's feet. Thus, when a person runs or walks with shoes on, the shoes isolate the feet from the outside, in addition to protecting the feet.

If a person weighing about 60 kg walks an average of 6,000 steps per day, a load of about 432 tons is consequently applied to the feet. This is equal to a load exceeding the weight (about 400 tons) of a typical jumbo jet used for international flights.

As such, the simplest method of developing a shoe that absorbs shocks transmitted to the sole of the foot is to reduce the hardness of the shoe. Provided that cushioning is simply defined as reducing a maximum force, good cushioning can be defined as absorbing shocks in order to prevent skeletal muscles from being strained. However, since a propulsive force as well as the cushioning is an important factor in exercise performance, it is undesirable that a given force be completely absorbed by a cushioning system. As a result, this is a complex problem, and it is not easy to define optimum shoe hardness for the responsive shock absorption of the skeletal muscles in the case where repeated shocks occur. This is why information about the magnitude of force should be acquired and considered.

Based on the result of analyzing a repulsive force against the ground during running using a pressure plate, it can be seen that the magnitude of a vertical force between the ground and the foot is two to three times as large as a person's weight. Assuming that the contact numbers of both feet and the ground during running are 1,000 times per 100 m, when the force that is two to three times as large as the weight acts as repeated load and shocks are not sufficiently absorbed, a joint may suffer from a degenerative change, and backache may also be caused. Thus, it is preferable to select running shoes with a good cushioning effect that guarantees excellent shock absorbing performance.

FIGS. 1(*a*) to 1(*c*) schematically illustrate a weight impact region on the sole of the foot during walking. In FIG. 1(*a*), for an initial 20 to 30 ins when a rear region of the foot comes into contact with the ground, an impact force is larger than the weight, that is, the foot is subjected to shocks that are 2.2 times as large as the weight. Thereafter, as shown in FIG. 1(*b*), in the state where the sole of the foot entirely comes into contact with the ground, the weight is larger than supporting force. Further, as shown in FIG. 1(*c*), as for force generated for 100 ins when a front region of the foot comes into contact with the ground to perform running again and then is taken off from the ground, the propulsive force is larger than the weight. That is, it is reported that the sole of the foot is subjected to load that is 2.8 times as large as the weight.

As such, it can be seen that the shocks applied to the sole of the foot during walking or running are larger than previously thought.

Thus, in order to mitigate these shocks, various types of shock absorbers, for example, airbags or sponge foam, are utilized. In the case of using a shock absorber, it is useful for absorbing shocks to some extent. However, the better the shock absorbing force is, the lower the repulsive force against the ground is. Thereby, when a user walks or runs for a lengthy period of time, the feeling of fatigue is further increased.

That is, in the structure of the shoe, the absorption of shocks that should be reduced when the foot is comes into contact with the ground and the repulsive elasticity that should be increased when the foot is taken off of the ground are symmetric to each other. When the shoe satisfies either of the shock absorption or the repulsive elasticity, the remaining one is undesirably sacrificed.

Further, the shoe is problematic in that the shock absorber may be broken or damaged by large shocks acting on the sole of the foot.

Furthermore, when the center of a user's weight leans to the front, shocks are not absorbed.

In order to overcome the above problems, the inventor(s) of the present invention filed KR Patent No. 10-1166466, which is entitled "shoe with shock absorbing means having high durability".

However, the cited invention is problematic in that the durability of a coupling portion between an upper shock absorbing portion and a lower shock absorbing portion is poor.

Further, it is problematic in that shocks transmitted to the shock absorbing means are mitigated at a center point rather than at opposite sides, with the result that the shoe is poor in balance performance and stability.

SUMMARY OF THE INVENTION

Accordingly, the present invention has been made keeping in mind the above problems occurring in the related art, and is intended to provide a shock absorbing shoe with a triangle shock absorbing space, which is superior in durability and is capable of maximally absorbing shocks generated when a wearer's foot comes into contact with the ground while walking.

Further, the present invention serves to provide a shock absorbing shoe with a triangle shock absorbing space, which has shock absorbing spaces in both a front area and a rear area of a midsole to absorb shocks, thus being capable of absorbing shocks when the shocks act on a front side of the shoe.

Furthermore, the present invention serves to provide a shock absorbing shoe with a triangle shock absorbing space, which disperses shocks to opposite sides, thus achieving high stability and balance.

In an aspect, the present invention provides a shock absorbing shoe with a triangle shock absorbing space, having an outsole and a midsole, wherein the midsole is divided into an upper midsole and a lower midsole, a plurality of upper seating holes being provided on opposite sides of the upper midsole behind an area corresponding to an arch region of a foot sole, a plurality of lower seating holes being provided on opposite sides of the lower midsole, the shock absorbing shoe comprising a shock absorbing means, the shock absorbing means including a body member formed longitudinally between the upper midsole and the lower midsole, and wing members provided on opposite sides of the body member, each of the wing members including an upper inclined portion inclined upwards to be received in the associated upper seating hole, a lower inclined portion inclined downwards to be received in the associated lower seating hole, and a connecting portion connecting the upper inclined portion with the lower inclined portion, so that the upper inclined portion, the lower inclined portion, and the connecting portion form a triangle shock absorbing space.

The shock absorbing shoe may further include a support portion that is provided on an end of the lower inclined portion and is formed inwards to surround a lower side of the lower midsole.

Further, the shock absorbing means may be further provided between the upper midsole and the lower midsole, in front of the area corresponding to the arch region of the foot sole.

The shock absorbing means located in front and rear areas, respectively, between the upper midsole and the lower midsole may be connected to each other via a connecting means.

As described above, the shock absorbing shoe according to the present invention is advantageous in that it can rapidly absorb shocks in a heel portion to which the most load of the foot is applied, thus providing optimum stability to a wearer.

Further, the shock absorbing shoe is advantageous in that the durability of the shoe is increased due to a contact between the shock absorbing space and the midsole of the shoe.

Furthermore, the shock absorbing shoe is advantageous in that shocks are absorbed in the front and rear areas of the shoe, thus allowing the shocks to be absorbed in a balanced manner.

Figure 1:
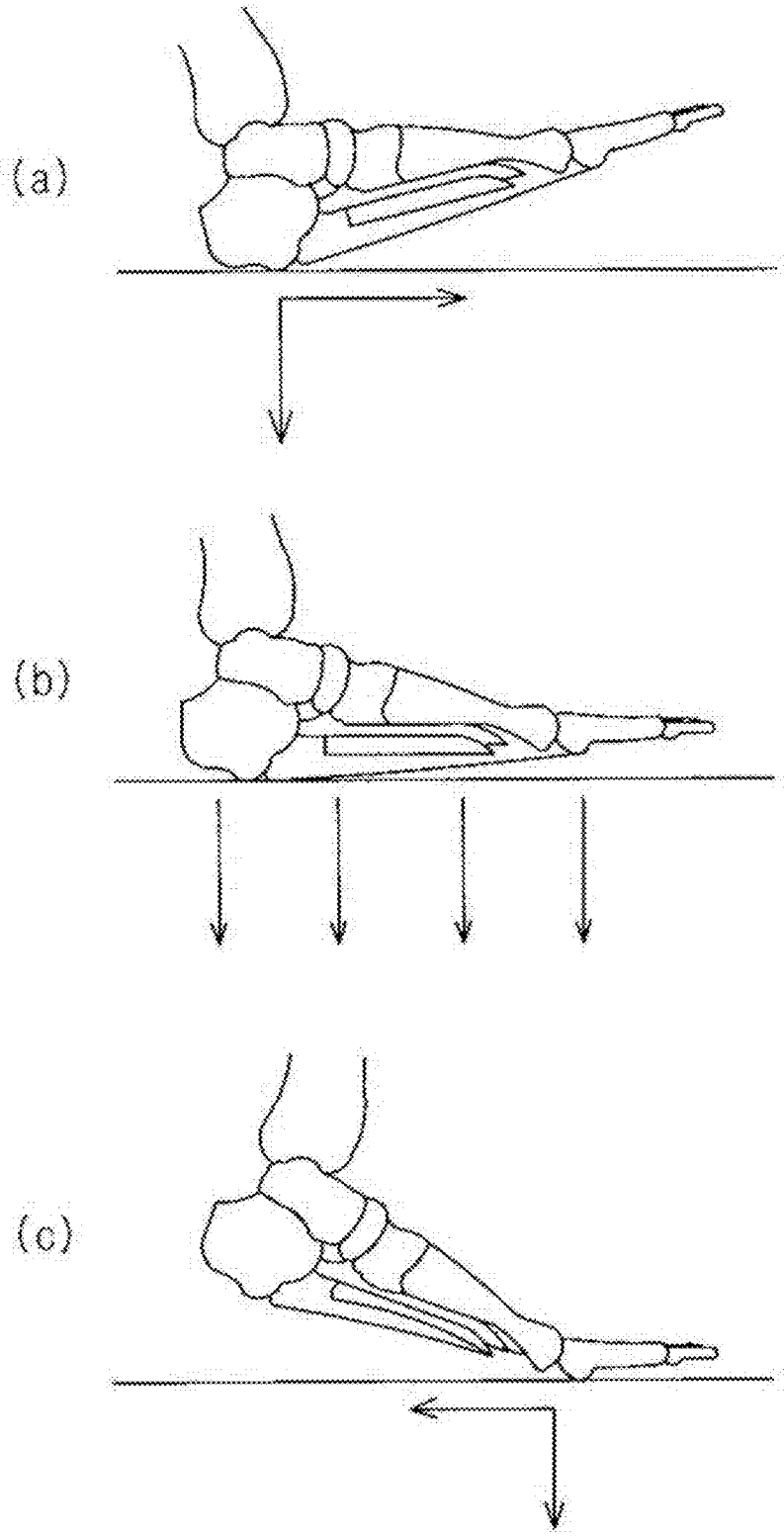
FIGS. 1(*a*) to 1(*c*) are schematic views schematically illustrating a weight impact region on the sole of the foot during walking.

| Description of Reference Numerals : | |
|---|---|
| 10: | midsole |
| 20: | upper midsole |
| 22: | upper seating hole |
| 30: | lower midsole |
| 32: | lower seating hole |
| 40: | outsole |
| 100: | shock absorbing means |
| 110: | body member |
| 120: | wing member |
| 122: | upper inclined portion |
| 124: | connecting portion |
| 126: | lower inclined portion |
| 128: | support portion |
| 129: | shock absorbing space |
| 300: | connecting means |

DETAILED DESCRIPTION OF THE INVENTION

Herein below, the shock absorbing shoe with the triangle shock absorbing space will be described with reference to the accompanying drawings.

Figure 2:
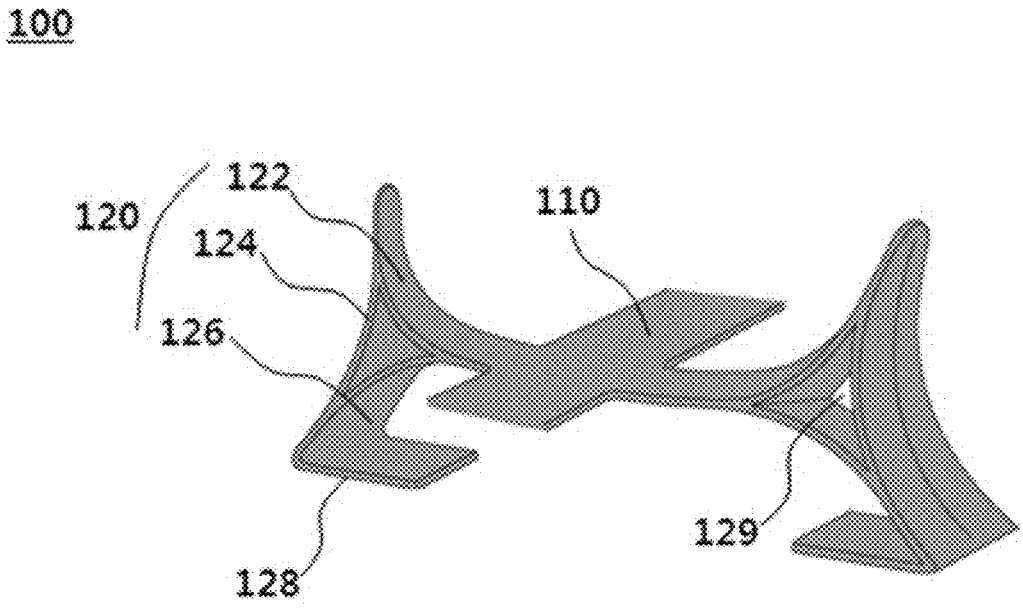
FIG. 2 is a perspective view illustrating a shock absorbing means of a shock absorbing shoe with a triangle shock absorbing space according to the present invention.
Figure 3:
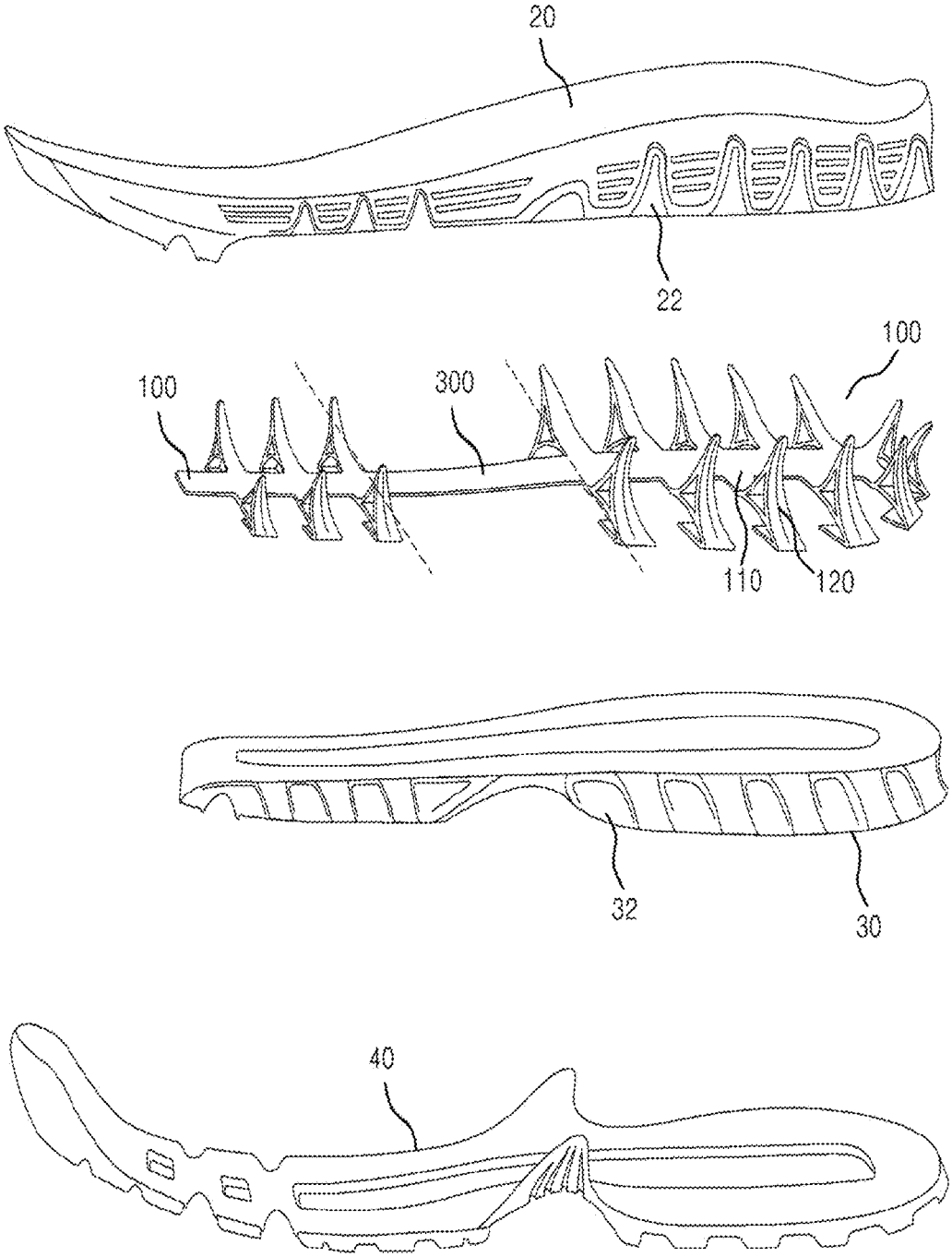
FIG. 3 is an exploded perspective view illustrating the shock absorbing shoe with the triangle shock absorbing space according to the present invention.
Figure 4:
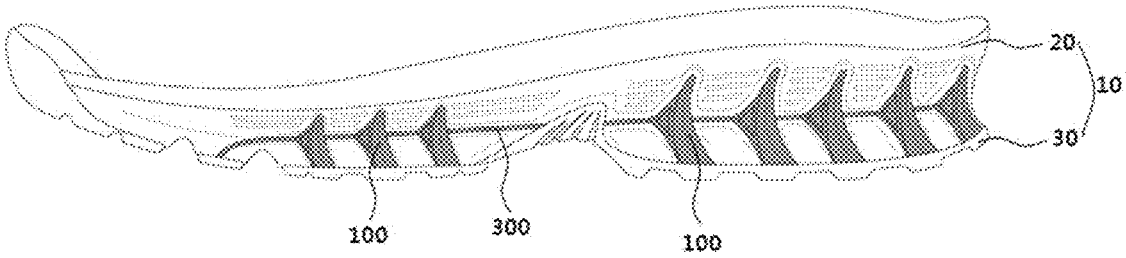
FIG. 4 is a perspective view illustrating the shock absorbing shoe with the triangle shock absorbing space according to the present invention.

FIG. 2 is a perspective view illustrating a shock absorbing means of a shock absorbing shoe with a triangle shock absorbing space according to the present invention, FIG. 3 is an exploded perspective view illustrating the shock absorbing shoe with the triangle shock absorbing space according to the present invention, and FIG. 4 is a perspective view illustrating the shock absorbing shoe with the triangle shock absorbing space according to the present invention.

As shown in FIGS. 2 to 4, the shock absorbing shoe according to the present invention has an outsole 40 and a midsole 10. The midsole 10 is divided into an upper midsole 20 and a lower midsole 30, a plurality of upper seating holes 22 is provided on opposite sides behind an area of the upper midsole corresponding to an arch region of the foot sole, and a plurality of lower seating holes 32 is provided on opposite sides of the lower midsole. The shock absorbing shoe includes a shock absorbing means 100 having a body member 110 and wing members 120. The body member 110 is formed longitudinally between the upper midsole 20 and the lower midsole 30. Each wing member 120 includes an upper inclined portion 122 that is formed on each of opposite sides of the body member 110 and inclined upwards to be received in the associated upper seating hole 22, a lower inclined portion 126 that is inclined downwards to be received in the associated lower seating hole 32, and a connecting portion 124 that connects the upper inclined portion 122 with the lower inclined portion 126. Thereby, the upper inclined portion 122, the lower inclined portion 126, and the connecting portion 124 form a triangle shock absorbing space 129.

The respective components will be described below in detail.

The midsole 10 according to the present invention is divided into the upper midsole 20 and the lower midsole 30, thus forming the shock absorbing means 100 between the upper midsole 20 and the lower midsole 30. Further, the upper midsole 20 is in contact with an insole of the shoe, while the lower midsole 30 is in contact with the outsole 40 of the shoe.

In detail, the plurality of upper seating holes 22 are formed on opposite sides of the upper midsole 20. Here, the upper seating holes 22 are formed behind an area of the midsole 10 that corresponds to an arch region of the foot sole when wearing the shoe.

Further, the upper seating holes 22 are formed on the opposite sides of the upper midsole 20 at predetermined intervals to meet at a rear surface of the upper midsole 20.

Moreover, the thickness of each upper seating hole 22 corresponds to that of the upper inclined portion 122 of the wing member 120, but is usually about 5 mm. Preferably, the height of the upper seating hole 22 is higher than a middle portion of a side surface of the upper midsole 20.

The plurality of lower seating holes 32 are formed on the opposite sides of the lower midsole 30. Here, similarly to the upper seating holes 22, the lower seating holes 32 are also formed behind the area of the midsole 10 that corresponds to the arch region of the foot sole when wearing the shoe.

Further, the lower seating holes 32 are also formed on the opposite sides of the lower midsole at predetermined intervals to meet at a rear surface of the lower midsole 30. The thickness and height of each lower seating hole are also formed in the same manner as the upper seating hole 22.

Particularly, a support hole is formed in a lower surface of the lower midsole 30 in such a way as to correspond to the support portion 128, so that the shock absorbing means 100 of the present invention is coupled to the support hole via the support portion 128, and thus surrounds the midsole 10.

Further, according to circumstances, the upper and lower seating holes 22 and 32 may be formed at corresponding positions if the shock absorbing means 100 is formed in front of areas of the upper and lower midsoles 20 and 30 corresponding to the arch region.

The shock absorbing means 100 according to the present invention is made of polyurethane and reinforced plastic mixture that is high in strength and hardness and is strong in elastic force, thus providing good physical properties. The material of the shock absorbing means 100 is not limited to the polyurethane or reinforced plastics, and may be naturally made of various materials that are high in strength and hardness and are good in rebounding elastic force.

The components of the shock absorbing means 100 according to the present invention include the body member 110 and the wing members 120.

The body member 110 is formed longitudinally in a central portion between the upper midsole 20 and the lower midsole 30, with the wing members 120 formed on the opposite sides of the body member.

Generally, the body member 110 is in the shape of a band having a predetermined width, and the wing members 120 are formed on the opposite sides of the body member 110 in such a way as to be arranged at predetermined intervals.

The wing members 120 are formed on the opposite sides of the body member 110 in such a way as to be located at a plurality of positions corresponding to the upper and lower seating holes 22 and 32.

Each wing member 120 mainly includes three components, namely, the upper inclined portion 122, the lower inclined portion 126, and the connecting portion 124.

Here, the upper inclined portion 122 is received in the associated upper seating hole 22, the lower inclined portion 126 is received in the associated lower seating hole 32, and the connecting portion 124 connects an end of the upper inclined portion 122 with an end of the lower inclined portion 126, thus defining a triangle shock absorbing space 129.

The upper inclined portion 122 extends from the side surface of the body member 110, and is inclined upwards such that an end thereof forms about 60° with a horizontal surface of the body member 110.

Thus, the upper inclined portion 122 may be directly formed on the body member 110 in such a way as to be inclined, or may extend to a predetermined position in a horizontal direction and then be bent in such a way as to be inclined.

Further, the upper inclined portion 122 may be bent in a curved shape or a straight-line shape to conform to the upper seating hole 22.

The lower inclined portion 126 extend from the side surface of the body member 110, and is inclined downwards such that an end thereof forms about 60° with the horizontal surface of the body member 110.

Similarly to the upper inclined portion 122, the lower inclined portion 126 may be directly formed on the body member 110 in such a way as to be inclined, or may extend to a predetermined position in a horizontal direction and then be bent in such a way as to be inclined. Further, the lower inclined portion 126 may be bent in a curved shape or a straight-line shape to conform to the lower seating hole 32.

The connecting portion 124 connects an end of the upper inclined portion 122 facing upwards with an end of the lower inclined portion 126 facing downwards, so that a closed space defines the shock absorbing space 129.

Thus, the shock absorbing space 129 approximately has the shape of a triangle. This enables shocks to be gradually mitigated from a center to opposite sides if load is applied to an object, when a triangle cushioning member is fitted under the heavy object. The shock absorbing space 129 intuitionally has the shape of the triangle. Here, sides of the triangle may be slightly curved or rounded.

In other words, when the wing member 120 is formed between the upper midsole 20 and the lower midsole 30 and a wearer walks with the shoe on, the shock absorbing space 129 serves as a cushion. Further, since the wing members 120 are provided on the opposite sides, shocks can be absorbed in a stable and balanced manner. As a result, this shoe is useful for improving walking habits and for walking remediation.

Preferably, the lower inclined portion 126 further has on an end thereof the support portion 128 that extends inwards to surround the lower side of the lower midsole 30.

Here, a large load may be transmitted to the shock absorbing space 129 and thereby the position of the shock absorbing means 100 may be changed between the upper midsole 20 and the lower midsole 30. In order to avoid it, the support portion 128 is formed on the lower inclined portion 126.

In order to insert the support portion 128 into the support hole of the lower midsole 30, the support portion is provided on an end of the lower inclined portion 126 in such a way as to extend towards the body member 110, thus surrounding the lower side of the lower midsole 30.

Preferably, the shock absorbing means 100 is further formed between the upper midsole 20 and the lower midsole 30 in front of an area corresponding to the arch region of the foot sole.

This is because people have their own walking manners, so more shocks may be transmitted to either the rear area or the front area of the arch region of the foot sole.

Therefore, the shock absorbing means 100 is formed on the front area between the upper midsole 20 and the lower midsole 30. Its configuration is equal to that of the above-mentioned midsole 10 having the upper and lower seating holes 22 and 32.

More preferably, the shock absorbing means 100 located in the front and rear areas between the upper midsole 20 and the lower midsole 30 are connected to each other by a connecting means 300. If the shock absorbing means 100 located between the upper midsole 20 and the lower midsole 30 are separated from each other, the shock absorbing means may be dislodged from their original positions over time. In order to avoid this, the shock absorbing means are connected to each other by the connecting means 300.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A shock absorbing shoe with a triangle shock absorbing space, having an outsole (40) and a midsole (10), wherein the midsole (10) is divided into an upper midsole (20) and a lower midsole (30), a plurality of upper seating holes (22) being provided on opposite sides of the upper midsole behind an area corresponding to an arch region of a foot sole, a plurality of lower seating holes (32) being provided on opposite sides of the lower midsole, the shock absorbing shoe comprising shock absorbing means (100), the shock absorbing means including:

a body member (110) formed longitudinally between the upper midsole (20) and the lower midsole (30); and wing members (120) provided on opposite sides of the body member (110), each of the wing members comprising:

an upper inclined portion (122) inclined upwards to be received in the associated upper seating hole (22);

a lower inclined portion (126) inclined downwards to be received in the associated lower seating hole (32); and a connecting portion (124) connecting the upper inclined portion (122) with the lower inclined portion (126), so that the upper inclined portion (122), the lower inclined portion (126), and the connecting portion (124) form a triangle shock absorbing space (129).

2. The shock absorbing shoe according to claim 1, wherein the shock absorbing means (100) is further provided between the upper midsole (20) and the lower midsole (30), in front of the area corresponding to the arch region of the foot sole.

3. The shock absorbing shoe according to claim 1 further comprising:

a support portion (128) provided on an end of the lower inclined portion (126) and formed inwards to surround a lower side of the lower midsole (30).

4. The shock absorbing shoe according to claim 2, wherein the shock absorbing means (100) is further provided between the upper midsole (20) and the lower midsole (30), in front of the area corresponding to the arch region of the foot sole.

5. The shock absorbing shoe according to claim 2, wherein the shock absorbing means (100) located in front and rear areas, respectively, between the upper midsole (20) and the lower midsole (30) are connected to each other via connecting means (300).

* * * * *